US005345888A

United States Patent [19]

Frankel

[11] Patent Number: 5,345,888

[45] Date of Patent: Sep. 13, 1994

[54] AUTOMATIC NEEDLE THREADER

[76] Inventor: Samuel R. Frankel, 211 Maple Ave., Shillington, Pa. 19607

[21] Appl. No.: 152,325

[22] Filed: Nov. 15, 1993

[51] Int. Cl.[5] ..... D05B 87/00

[52] U.S. Cl. ..... 112/225; 112/DIG. 3

[58] Field of Search ..... 112/225, DIG. 2, DIG. 3, 112/302, 224; 223/99

[56] References Cited

U.S. PATENT DOCUMENTS

| | | | |
|---|---|---|---|
| 4,075,959 | 2/1978 | Zocher | 112/225 |
| 4,198,915 | 4/1980 | Peterson et al. | 112/225 |
| 5,269,244 | 12/1993 | Cataletto | 112/302 |

*Primary Examiner*—Peter Nerbun
*Attorney, Agent, or Firm*—Max Goldman

[57] ABSTRACT

An automatic needle threader, which uses compressed air to thread the needles of sewing machines, has means for imparting a rotational or swirling motion to the air which smooths out the frayed ends of the thread for easier and more positive threading. The compressed air is directed into an air chamber in which a spiral shaped baffle is mounted to impart the swirling motion. The threader can be permanently mounted on a sewing machine with a hinge connection allowing the threader to be moved out of position when not in use and to be moved into position so that the exiting end of the air chamber is located adjacent and opposite the eye of the needle. Alternatively, the threader may be removably mounted to a sewing machine using straps connected to the hinge.

19 Claims, 2 Drawing Sheets

AUTOMATIC NEEDLE THREADER

BACKGROUND OF THE INVENTION

This invention relates generally to devices for the threading of needles in sewing machines, and more specifically to a device which automatically applies thread through the eye of a needle using a rotating or swirling stream of compressed air.

Various devices for threading of needles are known. U.S. Pat. No. 258,345 (Altmann et al.); U.S. Pat. No. 303,030 (McPherron); and U.S. Pat. No. 906,985 (Anderson) disclose mechanical devices attached to sewing machines to assist in the threading of needles. A hand-held mechanical device which uses a hook to pull the thread through the eye of the needle is disclosed in U.S. Pat. No. 2,711,272 (Gerstein).

Devices which attach to sewing machines and which use vacuums or compressed air to draw threads through the eyes of needles are disclosed in U.S. Pat. No. 2,413,014 (Wall); U.S. Pat. No. 3,540,392 (Kaplan); U.S. Pat. No. 3,599,587 (Greulich); U.S. Pat. No. 3,763,804 (Reich); and U.S. Pat. No. 4,198,915 (Peterson et al.).

U.S. Pat. Nos. 4,184,443 and 4,188,896 (Brown et al.) disclose diaphragm pumps for threading needles on sewing machines.

However, an automatic needle threader which uses compressed air and which creates a rotating or swirling motion to the air to force the loose fibers created by fraying at or near the end of the thread back toward the body of the thread, as does the instant invention, thereby improving, and eliminating problems associated with, the needle threading process, is not shown in the prior art.

OBJECTS OF THE INVENTION

Accordingly, it is the general object of the instant invention to provide an automatic needle threader which improves upon and overcomes the shortcomings of present devices.

It is a further object of the instant invention to provide an automatic needle threader which smooths the fraying of the thread at or near the end of the thread.

It is still a further object of the instant invention to provide an automatic needle threader which uses a stream of compressed air fed through a funnel which imparts a rotating motion to the air to smooth frayed areas of the thread.

It is still yet a further object of the instant invention to provide an automatic needle threader which can either be permanently attached to a sewing machine or which can be removably attached to a sewing machine.

It is another object of the instant invention to provide an automatic needle threader which is hingedly connected to a sewing machine so that it may be rotated into place when in use and may be rotated back to a storage position when not in use.

It is still another object of the instant invention to provide an automatic needle threader which is easy and inexpensive to manufacture and which can be attached to new sewing machines upon their manufacture or which can be easily attached to existing sewing machines.

SUMMARY OF THE INVENTION

These and other objects of the instant invention are achieved by providing an automatic needle threader which is hingedly attached to a sewing machine and which applies compressed air to a funnel having a helical baffle. As the compressed air flows through the funnel, toward the spout end of the device, the compressed air pushes the end of the thread forward through the eye of the needle while, at the same time, the frayed end of the thread is smoothed out by the swirling of the compressed air. This assures that the needle will be threaded without the difficulty associated with loose fibers due to fraying at the end of the thread.

The device can be rotated out of the way when not in use. When the operator desires to use the device, the device can be rotated so that the end of the threader is positioned directly opposite the eye of the needle for threading.

DESCRIPTION OF THE DRAWING

Other objects and many of the intended advantages of this invention will be readily appreciated when the same becomes better understood by reference to the following detailed description when considered in connection with the accompanying drawings wherein.

DETAILED DESCRIPTION OF THE PREFERRED EMBODIMENTS

Figure 1:
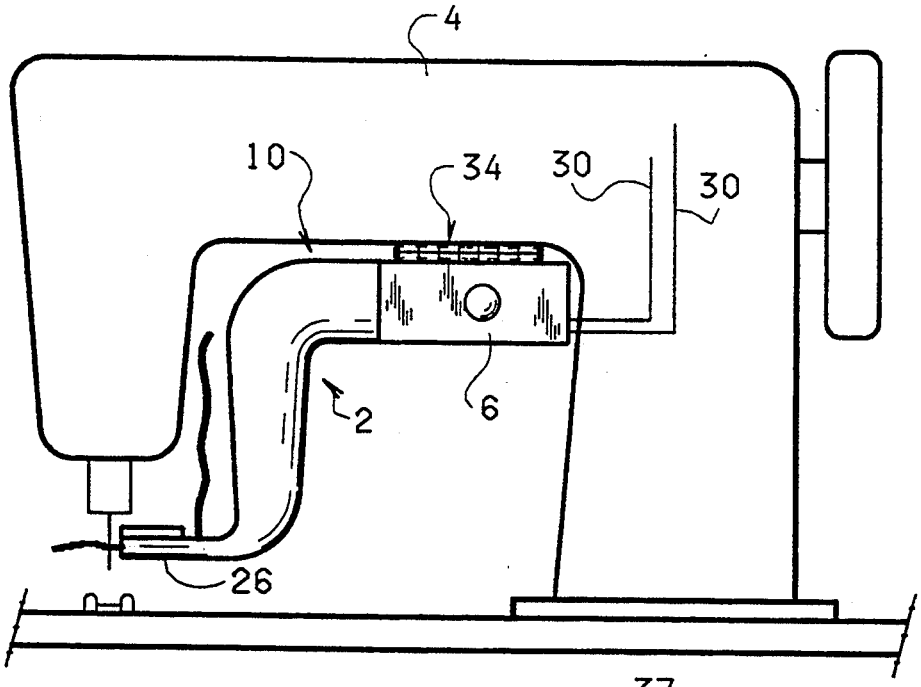
FIG. 1 is a side view of the automatic needle threader attached to a sewing machine.
Figure 2:
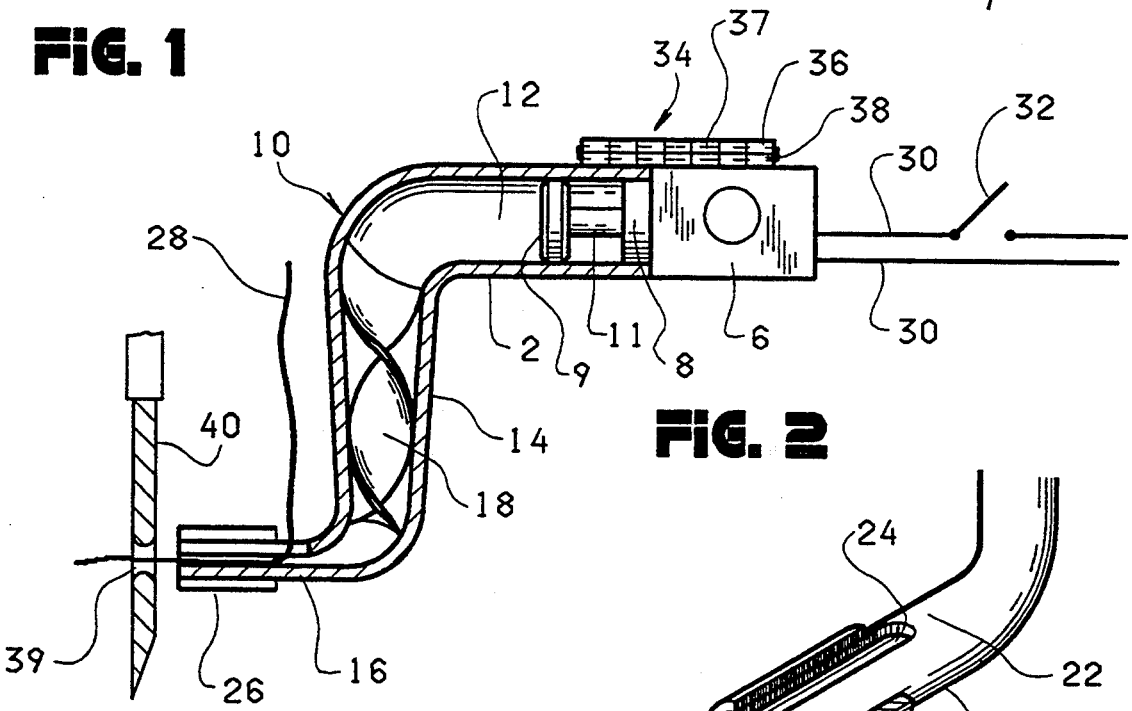
FIG. 2 is an enlarged side view of the automatic needle threader, partially in section.

Referring now in greater detail to the various figures of the drawing, wherein like reference characters refer to like parts, there is shown in FIGS. 1 and 2 the automatic needle threader 2 of the instant invention attached to a sewing machine 4. The automatic needle threader 2 has a housing 6 in which is mounted a solenoid 8. The housing 6 is connected to an S-shaped tubular air chamber 10 which has a proximal section 12, a funnel section 14 and a spout section 16.

As can be seen in FIG. 2, the solenoid 8, when operated, pushes against a piston 11 against a wall 9 in the proximal section 12, thereby producing a stream of compressed air. As will be described in detail later, this occurs when a button or switch, which applies electrical power to the solenoid 8, is operated.

The funnel section 14 comprises a helical baffle 18. As the compressed air moves through the chamber 10, the helical baffle 18 impels the compressed air into a rotational or swirling motion.

Figure 3:
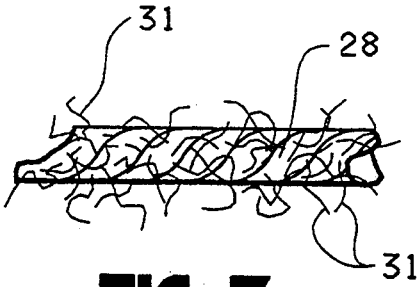
FIG. 3 is an enlarged representation of a thread which is frayed and has loose fibers.

Referring now to FIG. 3 the frayed end of the thread 28, with loose fibers 31 is shown. The loose fibers 31 are caused to move back to the surface of the thread by the rotating compressed air thereby smoothing the thread and removing the fraying.

Figure 4:
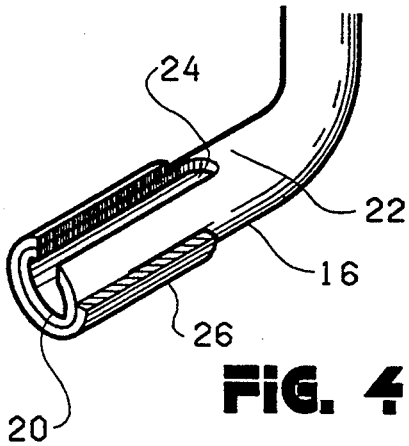
FIG. 4 is an enlarged isometric view of the spout end of the automatic needle threader with the rotatable jacket at the end of the spout positioned for the accepting of thread for the threading operation.

Referring now to FIGS. 2 and 4, it can be seen that the spout section 16 has an upper surface 22 in which a slot 24 has been placed. A rotatable jacket 26 is affixed so that after the end of the thread has been inserted into the slot 24, the jacket 26 may be rotated, closing the portion of the slot 24 proximal to the end 20 of the spout 16.

As can be seen in FIGS. 1 and 2, the automatic needle threader includes a hinge 34. The hinge 34 comprises a first member 36, which is attached to the sewing machine 4 and is pivotally connected, via a horizontally disposed hinge pin 37, to a second member 38, which is in turn attached to the housing 6. Thus, when the automatic needle threader is not in use, the hinge 34 allows the operator to rotate the automatic needle threader 2 about the longitudinal axis of the hinge pin 37, upward (i.e., out of the page of FIG. 2), and away from the needle 39 of the sewing machine 4. For use, the device is rotated downward into position as shown in FIGS. 1 and 2 is placed into the slot 24. The jacket 26 is then rotated to close the end of the slot 24 and a switch 32, connected to wires 30, is activated. The wires 30 are connected to, and apply power to, the solenoid 8 which causes the solenoid piston 11 to move forward toward the wall 9. A small opening in the wall 9 (not shown) allows compressed air to flow into the air chamber 10, and after the swirling, rotational motion is imparted to the air by the helical baffle 18, the air then pushes the end of the thread forward through the eye 39 of the needle 40.

Figure 5:
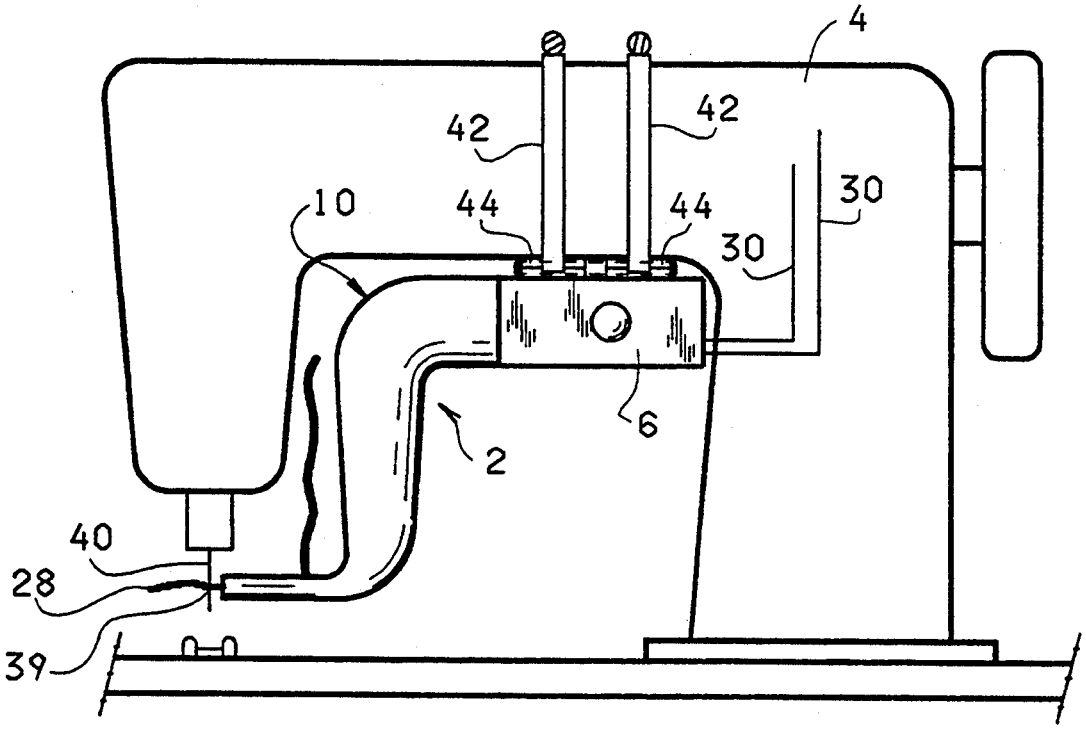
FIG. 5 is a side view showing the automatic needle threader removeably attached to an existing sewing machine.

FIG. 5 shows the automatic needle threader 2 removably installed on an existing sewing machine. The housing 6 connects to the lower portion of the hinges 44 while the upper portions of the hinges 44 are held against the lower wall of the sewing machine 4 by straps 42. As in the case of the permanently installed threader, the threader 2 may be rotated out of the way via the hinges 44 when not in use and rotated downward so that the spout 16 is opposite the eye 39 of the needle 40 when in use.

Figure 6:
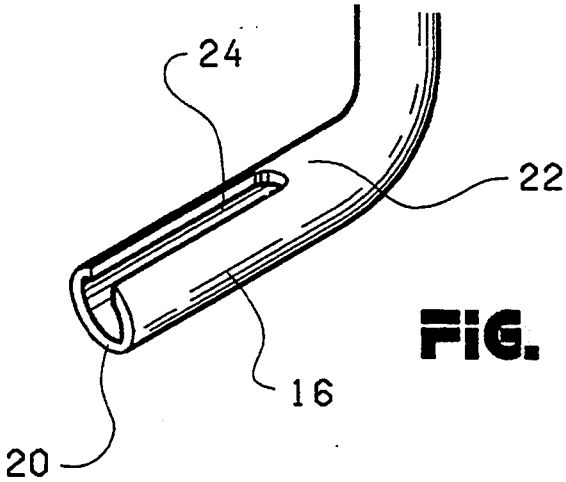
FIG. 6 is an isometric enlarged view of the spout end of the automatic needle threader without the rotatable jacket.

FIG. 6 shows an alternative embodiment wherein the rotatable jacket 26 is not attached to the spout 16. This is because the jacket 26 is usually required with heavier threads such as cotton threads, whereas it has been found that the automatic needle threader works as intended without the jacket 26 when synthetic threads such as nylon, orlon or the like are used.

An automatic needle threader has been described which uses compressed air and a spiral baffle to impart rotation to the compressed air to smooth out the end of frayed threads in order to ease and simplify the threading operation. The threader can be applied to new machines prior to shipment, or removably applied to existing sewing machines.

Without further elaboration, the foregoing will so fully illustrate my invention, that others may, by applying current or future knowledge, readily adapt the same for use under the various conditions of service.

I claim:

1. An automatic needle threader for a sewing machine comprising a housing; an air chamber attached to said housing; a hinge having a first section adapted to be connected to said sewing machine and a second section being pivotally connected, via a horizontally disposed hinge pin, to said first section and being connected to said housing, said air chamber comprising a proximal section having a first and a second end, said first end being attached to said housing; a funnel section having a third and a fourth end, said third end being attached to said second end; and a spout section attached to said fourth end; a means for providing compressed air into said chamber; and a means for imparting a swirling motion to said compressed air.

2. The automatic needle threader of claim 1 wherein said means for imparting a swirling motion to said air comprises a helical baffle mounted within said funnel section.

3. The automatic needle threader of claim 2 wherein said means for providing compressed air into said chamber comprises a solenoid.

4. The automatic needle threader of claim 3 wherein said proximal section comprises a wall having an opening therein and said means for providing compressed air further comprises a piston which is responsive to said solenoid and is propelled forward to said wall when said solenoid is activated.

5. The automatic needle threader of claim 4 wherein said threader further comprises an electrical switch connected to said solenoid and wherein operation of said electrical switch activates said solenoid.

6. The automatic needle threader of claim 5 wherein said spout comprises an upper surface, an access slot cut in said upper surface, and a rotatable jacket attached to said spout.

7. The automatic needle threader of claim 1 wherein said spout comprises an upper surface, an access slot cut in said upper surface, and a rotatable jacket attached to said spout.

8. The automatic needle threader of claim 7 wherein said means for imparting swirling motion to said air comprises a helical baffle mounted within said funnel section.

9. The automatic needle threader of claim 8 wherein said means for providing compressed air into said chamber comprises a solenoid and an electrical switch connected to said solenoid.

10. The automatic needle threader of claim 9 wherein said proximal section comprises a wall having an opening therein and said means for providing compressed air further comprises a piston which is responsive to said solenoid and is propelled forward to said wall when said solenoid is activated.

11. The automatic needle threader of claim 10 wherein said threader comprises an electrical switch connected to said solenoid wherein operation of said electrical switch activates said solenoid thereby impelling said piston forward toward said wall.

12. An automatic needle threader comprising a housing; an air chamber attached to said housing; a means for attaching said housing to a sewing machine, said air chamber comprising a proximal section having a first and a second end, said first end attached to said housing; a funnel section having a third and a fourth end, said third end being attached to said second end of said air chamber; a spout section attached to said fourth end; means for smoothing the frayed end of a single thread comprising means for providing compressed air into said chamber; and means for imparting a swirling motion to said compressed air.

13. The automatic needle threader of claim 12 wherein said means for imparting a swirling motion to said air comprises a helical baffle mounted within said funnel section.

14. The automatic needle threader of claim 13 wherein said means for removably attaching said housing to said sewing machine comprises at least one strap and at least one hinge connected to said strap, said at least one hinge having a first and second section, said second section being pivotally connected to said first section, via a horizontally disposed hinge, and being connected to said housing.

15. The automatic needle threader of claim 14 wherein said means for providing compressed air into said chamber comprises a solenoid.

16. The automatic needle threader of claim 15 wherein said proximal section comprises a wall having an opening therein and said means for providing compressed air furhter comprises a piston which is responsive to said solenoid and is propelled forward to said wall when said solenoid is activated.

17. The automatic needle threader of claim 16 wherein said threader further comprises an electrical switch connected to said solenoid wherein operation of said electrical switch activates said solenoid.

18. The automatic needle threader of claim 17 wherein said spout comprises an upper surface, an access slot cut in said upper surface, and a rotatable jacket attached to said spout.

19. An automatic needle threader for a sewing machine comprising a housing; an air chamber attached to said housing; means for removably attaching said housing to said sewing machine, said air chamber comprising a proximal section having a first and a second end, said first end attached to said housing; a funnel section having a third and a fourth end, said third end being attached to said second end of said housing; a spout section attached to said fourth end; means for providing compressed air into said chamber; and means for imparting a swirling motion to said compressed air, comprising a helical baffle mounted within said funnel section.

* * * * *